US008444778B2

(12) United States Patent
Uehara et al.

(10) Patent No.: US 8,444,778 B2
(45) Date of Patent: May 21, 2013

(54) LOW-THERMAL-EXPANSION NI-BASED SUPER-HEAT-RESISTANT ALLOY FOR BOILER AND HAVING EXCELLENT HIGH-TEMPERATURE STRENGTH, AND BOILER COMPONENT AND BOILER COMPONENT PRODUCTION METHOD USING THE SAME

(75) Inventors: Toshihiro Uehara, Yasugi (JP); Takehiro Ohno, Yasugi (JP); Akihiro Toji, Yasugi (JP); Takashi Sato, Kure (JP); Gang Bao, Kure (JP); Shinya Imano, Chiyoda-Ku (JP); Hiroyuki Doi, Chiyoda-Ku (JP)

(73) Assignees: Hitachi Metals, Ltd., Tokyo (JP); Babcock-Hitachi Kabushiki Kaisha, Tokyo (JP); Hitachi, Ltd., Tokyo (JP)

( * ) Notice: Subject to any disclaimer, the term of this patent is extended or adjusted under 35 U.S.C. 154(b) by 431 days.

(21) Appl. No.: 12/675,688

(22) PCT Filed: Aug. 29, 2008

(86) PCT No.: PCT/JP2008/065547

§ 371 (c)(1),
(2), (4) Date: May 21, 2010

(87) PCT Pub. No.: WO2009/028671

PCT Pub. Date: Mar. 5, 2009

(65) Prior Publication Data

US 2010/0226814 A1 Sep. 9, 2010

(30) Foreign Application Priority Data

Aug. 31, 2007 (JP) ..... 2007-225702

(51) Int. Cl.
*C22C 19/05* (2006.01)
*C22F 1/10* (2006.01)

(52) U.S. Cl.
USPC ..... 148/428; 148/556; 148/677; 420/449; 420/450

(58) Field of Classification Search
USPC ..... 148/428, 556, 677; 420/449, 450
See application file for complete search history.

(56) References Cited

U.S. PATENT DOCUMENTS

| | | | | |
|---|---|---|---|---|
| 4,569,824 | A * | 2/1986 | Duhl et al. | 420/448 |
| 2002/0015656 | A1 | 2/2002 | Magoshi et al. | |

FOREIGN PATENT DOCUMENTS

| | | | |
|---|---|---|---|
| JP | 05-070895 | A | 3/1993 |
| JP | 09-157779 | A | 6/1997 |
| JP | 10-317079 | A | 12/1998 |
| JP | 2000-256770 | A | 9/2000 |
| JP | 2004-003000 | A | 1/2004 |
| JP | 2006-124776 | A | 5/2006 |
| JP | 2006-176864 | A | 7/2006 |
| JP | 2007-154213 | A | 6/2007 |

OTHER PUBLICATIONS

ASM International, Materials Park, Ohio, ASM Specialty Handbook: Nickel, Cobalt, and Their Alloys: "Metallography, Microstructures, and Phase Diagrams of Nickel and Nickel Alloys", Dec. 2000, vol. 2, pp. 302-304.*

International Search Report dated Oct. 14, 2008.

* cited by examiner

*Primary Examiner* — Jesse R. Roe
(74) *Attorney, Agent, or Firm* — Sughrue Mion, PLLC

(57) ABSTRACT

Disclosed is a low-thermal-expansion Ni-based super-heat-resistant alloy for a boiler, which has excellent high-temperature strength. The alloy can be welded without the need of carrying out any aging treatment. The alloy has a Vickers hardness value of 240 or less. The alloy comprises (by mass) C in an amount of 0.2% or less, Si in an amount of 0.5% or less, Mn in an amount of 0.5% or less, Cr in an amount of 10 to 24%, one or both of Mo and W in such an amount satisfying the following formula: Mo+0.5 W=5 to 17%, Al in an amount of 0.5 to 2.0%, Ti in an amount of 1.0 to 3.0%, Fe in an amount of 10% or less, and one or both of B and Zr in an amount of 0.02% or less (excluding 0%) for B and in an amount of 0.2% or less (excluding 0%) for Zr, with the remainder being 48 to 78% of Ni and unavoidable impurities.

5 Claims, No Drawings

LOW-THERMAL-EXPANSION NI-BASED SUPER-HEAT-RESISTANT ALLOY FOR BOILER AND HAVING EXCELLENT HIGH-TEMPERATURE STRENGTH, AND BOILER COMPONENT AND BOILER COMPONENT PRODUCTION METHOD USING THE SAME

CROSS REFERENCE TO RELATED APPLICATIONS

This application is a National Stage of International Application No. PCT/JP2008/065547 filed Aug. 29, 2008, claiming priority based on Japanese Patent Application No. 2007-225702 filed Aug. 31, 2007, the contents of all of which are incorporated herein by reference in their entirety.

TECHNICAL FIELD

The present invention relates to a low-thermal-expansion Ni-base superalloy for boilers, which has excellent high temperature strength and low thermal expansion characteristics to be suitably used for tubes, plates, bars, forgings, and so on used in the boiler for an ultra supercritical pressure steam power plant operated at a steam temperature of not lower than 700° C., and to boiler components using the same, and to a method of producing the boiler components.

BACKGROUND TECHNOLOGY

It is required that efficiency of a thermal power plant be raised due to recent years demands for economizing the use of fossile fuels, reduction in carbon dioxide emissions, and the like for measures against global warming. In order to raise the efficiency of the thermal power plant, its operations at a higher steam temperature is necessary. The main steam temperature of a conventional boiler for power generation is, at most, about 600° C. even in the case of an ultra supercritical pressure steam power plant, however, a plan is under progress to raise the main steam temperature to 650° C. and further up to a level exceeding 700° C. In the conventional case where a boiler is operated at the main steam temperature of about 600° C., as a material for a large diameter thick-walled tube such as a boiler tube and piping, heat resistant ferritic steel has been used. This is because the heat resistant ferritic steel has the merit of having excellent high temperature strength of up to about 600° C. and a small thermal expansion coefficient and of being comparatively low-priced. However, in the case of not lower than 650° C., the heat resistant ferritic steel is lacking in high temperature strength and oxidation resistance property. Thus, austenitic stainless steel having more excellent high temperature strength and higher oxidation resistance has been proposed to use (cf. JP-A-2004-3000).

DISCLOSURE OF THE INVENTION

Problems to be Solved by the Invention

While the steam temperature of the boilers for power generation is being made higher as set forth above, in the case of not lower than 700° C. of the steam temperature, even the austenitic stainless steel is unsatisfactory in high temperature strength. Therefore, in the case of not lower than 700° C. of the steam temperature, a Ni-base superalloy having more excellent high temperature strength will be needed as a material for a header, piping, heat exchanger tube of a superheater, and so on. When applying such a material to the header and piping, important problems for designing those are not only ensuring high temperature strength of the material but also a characteristic of thermal elongation of the material when starting and stopping of operation increase as compared with the conventional heat resistant ferritic steel. In the case of the heat exchanger tube of the superheater in a fire furnace, the tube is directly exposed to high temperature combustion gases, higher strength at a higher temperature is required for the tube.

Accordingly, an object of the present invention is to provide a low-thermal-expansion Ni-base superalloy for boilers, which can have improved high temperature strength and lower thermal expansion coefficient and be applicable to welding, and boiler components made of the Ni-base superalloy, and a method of producing the boiler components.

Means for Solving the Problems

The present inventors attained the invention by finding out an alloy composition which enables a precipitation strengthening Ni-base superalloy to maintain its excellent high temperature strength and its ductility to be improved and its thermal expansion coefficient to be kept low and also by finding that the Ni-base superalloy, even if its aging treatment is omitted, can maintain its excellent high temperature strength being close to that of its original precipitation strengthening Ni-base alloy.

Thus, according to a first aspect of the present invention, there is provided a low-thermal-expansion Ni-base superalloy for boilers, having excellent in high temperature strength, and having the following chemical composition.

The Ni-base superalloy has a Vickers hardness of not more than 240, and consists essentially of, by mass, not more than 0.2% C, not more than 0.5% Si, not more than 0.5% Mn, 10 to 24% Cr, at least one of Mo and W in an amount in terms of an equation of "Mo+0.5W"=5 to 17%, 0.5 to 2.0% Al, 1.0 to 3.0% Ti, not more than 10% Fe, and at least one of B and Zr in amounts of from exclusive zero to 0.02% B and from exclusive zero to 0.2% Zr, and the balance of Ni and unavoidable impurities.

Preferably the low-thermal-expansion Ni-base superalloy consisting essentially of, by mass, 0.005 to 0.15% C, 15 to 24% Cr, 1.2 to 2.5% Ti, not more than 5% Fe, at least one of B and Zr in amounts of 0.002 to 0.02% B and 0.01 to 0.2% Zr, and the balance of 48 to 78% Ni and unavoidable impurities.

More preferably the Ni-base superalloy comprises, by mass, 0.5 to 1.7% Al, 1.2 to 1.8% Ti, not more than 2% Fe, and 50 to 75% Ni.

More preferably the Ni-base superalloy satisfies a requirement that a value defined by an equation of Al/(Al+0.56Ti) is 0.45 to 0.70.

According to a second aspect of the present invention, there is provided a boiler component made of the above Ni-base superalloy, wherein no precipitates of a γ phase having a size of not less than 20 nm exist in an alloy matrix of the Ni-base superalloy other than a weld portion and a heat affected zone by welding.

According to a third aspect of the present invention, there is provided a method of producing a boiler component made of the above Ni-base superalloy, the method comprising the steps of:

melting the Ni-base superalloy;

casting the molten Ni-base superalloy to obtain an ingot;

subjecting the ingot to plastic working of at least one of hot working and cold working; and subjecting the worked product to solution heat treatment at a temperature of 980 to 1100° C., wherein an obtained final product as not aged has a Vickers hardness of not more than 240.

EFFECT OF THE INVENTION

The low-thermal-expansion Ni-base superalloy for boilers of the present invention is excellent in high temperature strength and high temperature ductility, and in high thermal fatigue property because of its low thermal expansion property. Further, according to the Ni-base superalloy, since welding is possible by virtue of no aging treatment, the superalloy can be used for production of boiler components, and it is possible to significantly improve strength of the boiler components at a high temperature of not lower than 700° C., thereby enhancing a possibility of realizing a ultra supercritical pressure steam power plant boiler using the superalloy operated at a temperature of not lower than 700° C.

BEST MODE CARRYING OUT THE INVENTION

The low-thermal-expansion Ni-base superalloy for boilers of the present invention is used for the boilers without aging treatment. This is because the Ni-base superalloy is inferior in weldability.

In general, after melting, casting, plastic working and solution heat treatment processes, Ni-base superalloys have been subjected to aging treatment to cause precipitates of a γ'phase to precipitate by ten to several ten percents thereby hardening the alloys in order to improve the high temperature strength. Therefore, there has been a problem that when welding is performed on the Ni-base superalloys which have been hardened by aging treatment, they are deteriorated in toughness and ductility resulting in that cracking in a high temperature or cracking by reheating is liable to occur because of high hardness of the Ni-base superalloys.

While a boiler material is necessarily subjected to welding, if it is subjected to aging treatment like as the usual Ni-base superalloys, the boiler material will be unsuitable for producing boiler components because of high hardness. According to a research by the present inventors, a hardness level of the Ni-base superalloys, at which cracking is liable to occur when welding, is not more than 240 of Vickers hardness, preferably not more than 220 of Vickers hardness, and more preferably not more than 205 of Vickers hardness. If the Vickers hardness is within the above range, it is possible to obtain not only an effect of restraining the cracking problem when welding but also an effect of improving workability when producing a boiler tube. Therefore, the present invention proposes an optimum chemical composition of the Ni-base superalloy which enables welding without aging treatment and can obtain substantially the same effect as the aging treatment with utilization of steam heat during using the Ni-base superalloy for boilers without usual aging treatment.

Herein below, there will be described about reasons for limiting the chemical composition in the following ranges in the low thermal expansion Ni-base superalloy for boilers of the present invention. Unless otherwise mentioned, the amount of respective component is expressed in a mass % unit.

C: not more than 0.2%

Carbon has an effect of preventing grain coarsening by forming carbide. However, if the carbon amount is excess, carbides are liable to precipitate in a form of a stringer and ductility is deteriorated in a perpendicular direction to a working direction and, further, carbon combines with Ti to produce a carbide, which makes it impossible to ensure the Ti amount enough to form the γ phase serving as a precipitation strengthening phase by originally combining with Ni and, as a result, strength is deteriorated. Thus, the carbon amount is limited to not more than 0.2%. The carbon amount is preferably 0.005 to 0.15%, more preferably 0.005 to 0.10%, further preferably 0.005 to 0.08%, and most preferably 0.005 to 0.05%.

Si: not more than 0.5%, and

Mn: not more than 0.5%

Si and Mn are used as dioxidizers when melting an alloy, however, if the Ni-base superalloy contains excess amounts of Si and Mn, hot workability is deteriorated, and also toughness when using the superalloy is deteriorated. Therefore, the Si amount is limited to not more than 0.5%, the Mn amount is limited to also not more than 0.5%. The each amount of Si and Mn is preferably not more than 0.03%, more preferably not more than 0.1%, and most preferably not more than 0.01%.

Cr: 10 to 24%

Cr is dissolved into a matrix to make a solid solution thereby improving oxidation resistance property of the alloy. If the Cr amount is less than 10%, the above improvement effect cannot be obtained especially at a high temperature exceeding 700° C., while an excessive additive amount of Cr makes plastic workability of the alloy to be difficult. Thus, the Cr amount is limited to 10 to 24%. Preferably the Cr amount is 15 to 24%, and the lower limit thereof is preferably not less than 18% and the higher limit is preferably not more than 22%. More preferably, the Cr amount range is 19 to 21%.

Mo+0.5W: 5 to 17%

Mo and W are important elements having an effect of lowering a thermal expansion coefficient of the alloy, so that one or more of Mo and W is indispensable. If the amount of "Mo+W/2" is less than 5%, the above effect is not obtainable and if the amount of "Mo+W/2" exceeds 17%, plastic workability of the alloy is deteriorated. Therefore, the additive amount of one or more of Mo and W is limited to 5 to 17% in terms of "Mo+0.5W". The additive amount of Mo and W is preferably 5 to 15% in terms of "Mo+0.5W", more preferably 5 to 12%. Moreover, if the content ratio of W is high, a LAVES phase is liable to occur thereby deteriorating ductility or hot workability of the alloy. Thus, a single addition of Mo is preferable, and its amount is preferably 8 to 12%, more preferably 9 to 11%.

Al: 0.5 to 2.0%

Al forms an intermetallic compound ($Ni_3Al$), which is a γ'phase, when the alloy is subjected to aging treatment, thereby improving high temperature strength of the alloy. In the present invention, since the steam temperature is high (i.e. not less than 700° C.), during operation a precipitation strengthening effect occurs by precipitation of the γ'phase like as the case of aging treatment. Thus, in the present invention, Al is added aiming occurrence of the precipitation strengthening effect during operation of the ultra supercritical pressure steam boiler at the steam temperature of not less than 700° C. In order to obtain the above effect, an additive amount of Al should be not less than 0.5%. However, if the Al amount exceeds 2%, hot workability is deteriorated. Thus, the Al amount is limited to 0.5 to 2.0%, preferably 0.5 to 1.7%.

Ti: 1.0 to 3.0%

Ti forms a γ'phase ($Ni_3(Al,Ti)$) together with Al. The γ'phase formed with Al and Ti exhibits more excellent high temperature strength as compared with the γ'phase formed only by Al. Thus, the Ti amount should be not less than 1%. However, if the Ti amount exceeds 3%, the γ'phase becomes unstable resulting in that a transformation from the γ'phase to η phase is liable to occur thereby deteriorating high temperature strength and hot workability. Therefore, the Ti amount is limited to 1.0 to 3.0%, preferably 1.2 to 2.5%, more preferably 1.2 to 1.8%.

Al/(Al+0.56Ti): 0.45 to 0.70

As set forth above, an amount balance between Al and Ti is important in the invention alloy. The more the amount rate of Al in the γ'phase is, the more the ductility of the alloy is improved while strength of the alloy is deteriorated. In the invention alloy, it is important that sufficient ductility is ensured, so that the value of Al/(Al+0.56Ti) is set in order to express the content ratio of Al in the γ'phase as an atomic weight ratio. If this value is lower than 0.45, the ductility is insufficient. On the other hand, if the value exceeds 0.7, the alloy strength lacks. The value is preferably 0.45 to 0.60.

Fe: not more than 10%

Although an additive Fe is not always needed, Fe has an effect of improving hot workability of the alloy, so that it may be added as occasion demands. If the additive amount of Fe exceeds 10%, the thermal expansion coefficient of the alloy becomes large, and oxidation resistance is deteriorated. Therefore, an upper limit of the Fe amount is preferably limited to 10%.

The amount is preferably not more than 5% and more preferably not more than 2%.

B: not more than 0.02% (exclusive 0%), and

Zr: not more than 0.02% (exclusive 0%)

One or more of B and Zr are added in the alloy.

B and Zr strengthen grain boundaries of the alloy thereby improving ductility of the alloy at a high temperature, so that one or more of B and Zr are added. However, an excessive addition thereof deteriorate the alloy in hot workability, so that the additive amounts of B and Zr are limited respectively to not more than 0.02%, and to not more than 0.2%. The B amount is preferably 0.002 to 0.02%, and the Zr amount is 0.01 to 0.2%.

Ni: Balance

The residuals other than the above additive elements are Ni and unavoidable impurities. With regard to the Ni amount calculated by excluding the unavoidable impurities, if it is less than 48%, a high temperature strength of the alloy is insufficient, so that it is preferably not less than 48%. If the Ni amount exceeds 78%, ductility of the alloy is deteriorated, so that the Ni amount is set to be not more than 78%. The lower limit of the Ni amount is preferably not less than 50% and more preferably not less than 54%. The upper limit of the Ni amount is preferably not more than 75% and more preferably not more than 72%.

The invention superalloy may contain other elements than those mentioned above, so long as they are in small amounts and essentially do not adversely affect characteristics of the superalloy. The following elements are such other elements.

P: not more than 0.05%, S: not more than 0.01, Nb: not more than 0.8%, Co: not more than 5%, Cu: not more than 5%, Mg: not more than 0.01%, Ca: not more than 0.01%, 0: not more than 0.02%, N: not more than 0.05%, and REM (rare-earth metals): not more than 0.1%.

Next, there will be provided a description of the invention producing method of the superalloy.

When the invention superalloy is applied to the ultra supercritical pressure steam boiler, after melting and casting of the alloy, plastic working, such as hot working or cold working following the hot working, is carried out to obtain a desired shape. The desired shape is a tube shape in almost all cases. The heat treatment such as solution treatment or annealing may be carried out among the processes of casting, hot working and cold working as occasion demands. These production processes are needed to form members and components for boilers. When needed, a further working of machining may be conducted. In any case, a state of a product subjected to heat treatment after working for providing the product with a desired shape is as subjected to a final solution treatment without aging treatment. The reason for leaving the superalloy without aging treatment is that since welding is often conducted when assembling boilers, the superalloy should be in a softened state so as not to occur cracking by welding. In such a softened state, a hardness of the superalloy is not more than 240 in Vickers hardness. Moreover, when the invention superalloy is used in the ultra supercritical pressure steam power plant operated at a steam temperature of not lower than 700° C., since an aging effect of precipitation strengthening is expectable by precipitation of fine particles of the γ' phase during operation, even if the superalloy is started to use as subjected to solution treatment, it is possible to obtain creep rupture strength almost as high as that of the superalloy as subjected to aging treatment. Therefore, it is possible to use the superalloy as subjected to solution treatment without necessity of aging treatment. However, if the temperature of the solution treatment is lower than 980° C., enough high temperature strength is not obtainable, since elements contributing to precipitation do not sufficiently dissolve into a matrix. On the other hand, if the solution treatment is conducted at a temperature exceeding 1,100° C., the superalloy is deteriorated in strength and ductility because of coarsening of crystal grains. Therefore, the solution treatment temperature is determined to be 980 to 1,100° C.

As occasion demands, it is possible to subject the superalloy to stabilizing treatment after the final solution treatment. Here, the stabilizing treatment is of a heat treatment which is conducted at a temperature of about 800 to about 900° C. for several hours to precipitate chromium carbides and other precipitates at crystal grain boundaries thereby improving creep rupture ductility of the superalloy. Although coarse particles of the γ' phase are formed intra-grains by the stabilizing heat treatment, since the particles are coarse, precipitation hardening effect is deficient, the stabilizing treatment may be conducted so far as no trouble occurs when conducting a welding work. A preferable temperature of the stabilizing treatment is 830 to 880° C.

Herein the term "without aging treatment" is used for a state of the superalloy which has not been subjected to an aging treatment at a temperature of from not lower than 650 to lower than 800° C. for not less than one hour. Namely, the term "without aging treatment" is used for a metal-structural state of the superalloy in which there is no coarse precipitates of the γ' phase, derived from aging treatment, in a matrix of an austenitic phase, particles of such precipitates having a size of not less than 20 nm and greatly enhancing the alloy strength. If the coarse particles of the γ' phase having a size of not less than 20 nm precipitate in the matrix of the austenitic phase, the matrix is hardened thereby arising a risk that the superalloy is deteriorated in weldability.

It is noted that for example, in the case where an appropriately sized material of the invention low-thermal-expansion Ni-base superalloy is subjected to welding to produce a tubular boiler component, the present inventors confirmed a maintained structural feature of the component that no precipitates having not less than 20 nm of the γ' phase exist in the base material (i.e. the matrix) except for a weld region and a heat affected zone of the material.

EXAMPLE

Herein below, with regard to the following examples, there will be provided a detailed description of the present invention.

Example 1

Alloy ingots of Invention alloy Nos. 1 and 3 to 9, Comparative alloy Nos. 11 and 12, and Conventional alloy No.

13), each having a weight of 10 kg, were prepared after melting in a vacuum induction furnace.

Table 1 shows chemical compositions of the Invention alloys, the Comparative alloys, and the Conventional alloy.

Specimens were sampled by cutting-out from the alloy materials in order to conduct a measuring test of hardness and other various tests.

TABLE 1

(mass %)

| No. | C | Si | Mn | Ni | Cr | Mo | W | Al | Ti | Fe | Zr | B | Co | Al/(Al + 0.56Ti) | Remarks |
|---|---|---|---|---|---|---|---|---|---|---|---|---|---|---|---|
| 1 | 0.04 | 0.05 | 0.02 | 64.55 | 20.34 | 8.14 | 3.98 | 1.06 | 1.72 | 0.07 | 0.02 | 0.0062 | — | 0.52 | Invention |
| 2 | 0.03 | 0.03 | 0.01 | 67.29 | 19.87 | 9.89 | — | 1.19 | 1.58 | 0.05 | 0.05 | 0.0053 | — | 0.57 | alloy |
| 3 | 0.02 | 0.02 | 0.01 | 66.11 | 20.69 | 9.71 | — | 1.23 | 1.47 | 0.69 | 0.04 | 0.0047 | — | 0.60 | |
| 4 | 0.03 | 0.02 | 0.01 | 67.49 | 19.07 | 10.30 | — | 1.57 | 1.39 | 0.06 | 0.05 | 0.0058 | — | 0.67 | |
| 5 | 0.05 | 0.04 | 0.03 | 66.20 | 22.36 | 7.29 | 0.4 | 1.26 | 1.63 | 0.73 | — | 0.0051 | — | 0.58 | |
| 6 | 0.03 | 0.03 | 0.02 | 66.40 | 19.21 | 11.50 | — | 0.94 | 1.74 | 0.12 | — | 0.0039 | — | 0.49 | |
| 7 | 0.02 | 0.05 | 0.05 | 62.39 | 19.27 | 15.41 | — | 1.18 | 1.53 | 0.09 | — | 0.0072 | — | 0.58 | |
| 8 | 0.04 | 0.01 | 0.02 | 65.17 | 21.06 | 9.39 | — | 1.73 | 1.41 | 1.13 | 0.03 | 0.0049 | — | 0.69 | |
| 9 | 0.03 | 0.02 | 0.01 | 66.21 | 20.60 | 10.81 | — | 1.11 | 1.12 | 0.08 | — | 0.0056 | — | 0.64 | |
| 11 | 0.04 | 0.04 | 0.02 | 67.78 | 19.47 | 9.86 | — | 0.47 | 1.54 | 0.77 | — | 0.0044 | — | 0.35 | Comparative |
| 12 | 0.03 | 0.02 | 0.01 | 67.16 | 19.39 | 10.30 | — | 1.82 | 0.98 | 0.28 | — | 0.0048 | — | 0.77 | alloy |
| 13 | 0.05 | 0.11 | 0.06 | 52.81 | 22.29 | 9.21 | — | 1.23 | 0.43 | 1.2 | — | 0.0046 | 12.6 | 0.84 | Conventional alloy |

Note 1:
The mark "—" means no addition.
Note 2:
The residual other than the above quantity is unavoidable impurities.

Thereafter, the invention alloys, comparative alloys, and conventional alloy are subjected to hot forging to produce 30 mm square bars, and subsequently to a solution treatment by holding those at a temperature of 1066° C. for 4 hours followed by air-cooling.

With regard to Invention alloy No. 2 shown in Table 1, an alloy ingot having a weight of about 1 ton was prepared after melting in a vacuum induction furnace followed by vacuum arc re-melting. The ingot was subjected to homogenizing annealing treatment at a temperature of 1140° C. followed by hot working to produce a bar having a cross-sectional size of 75 mm×130 mm square, and further followed by a solution heat treatment of holding the bar at a temperature of 1066° C. for 4 hours and subsequent air-cooling.

For the sake of comparison, after the above solution heat treatment of Invention alloy No. 2, it was subjected to stabilizing treatment of holding at a temperature of 850° C. for 4 hours followed by air-cooling, and to an aging treatment at a temperature of 760° C. for 16 hours followed by a subsequent air-cooling treatment.

First, with regard to cylindrical bar specimens each having a diameter of 5 mm and a length of 19. 5 mm, a thermal expansion coefficient was measured longitudinally as a function of temperature from 30° C. to 750° C. with utilization of a differential thermal expansion measuring apparatus by heating the respective specimen at a heating rate of 10° C./min. in an atmosphere of Ar gas.

Next, specimens for a tensile test and for a creep rupture test were sampled by cutting-out from the alloy materials, and the tensile test at a temperature of 750° C. and the creep rupture test at a temperature of 750° C. under a load of 200 MPa were conducted.

With regard to the specimens as subjected to the solution heat treatment, a result of an evaluation of alloy characteristics is shown in Table 2. Further, with regard to Invention alloy No. 2 after subjected to a final heat treatment of aging, a result of an evaluation of alloy characteristics is shown in Table 3.

TABLE 2

| No. | Thermal expansion coefficient (RT-750° C.) ($\times 10^{-6}$/° C.) | Hardness (Hv) | High temperature tensile properties (750° C.) 0.2% yield strength (MPa) | Tensile strength (MPa) | Elongation (%) | Reduction of area (%) | 750° C. creep rupture properties (200 MPa) Time to rupture (h) | Reduction of area (%) | Remarks |
|---|---|---|---|---|---|---|---|---|---|
| 1 | 14.7 | 202 | 414 | 667 | 29.1 | 38.7 | 2921 | 49.6 | Invention |
| 2 | 14.8 | 196 | 396 | 653 | 30.3 | 42.4 | 2843 | 56.2 | alloy |
| 3 | 14.8 | 193 | 393 | 649 | 31.6 | 43.6 | 2792 | 58.7 | |
| 4 | 14.9 | 197 | 421 | 665 | 29.6 | 39.3 | 3124 | 51.4 | |
| 5 | 15.0 | 191 | 364 | 636 | 32.8 | 44.1 | 2247 | 59.8 | |
| 6 | 14.6 | 199 | 432 | 678 | 28.9 | 38.2 | 3362 | 46.4 | |
| 7 | 14.1 | 208 | 419 | 672 | 27.4 | 37.6 | 3756 | 45.7 | |
| 8 | 14.9 | 192 | 394 | 647 | 31.1 | 42.9 | 2473 | 61.3 | |
| 9 | 14.8 | 191 | 367 | 638 | 33.4 | 44.2 | 2239 | 61.8 | |
| 11 | 14.7 | 193 | 381 | 641 | 25.6 | 35.3 | 2814 | 24.8 | Comparative |
| 12 | 14.9 | 194 | 338 | 612 | 35.8 | 45.9 | 1822 | 57.4 | alloys |
| 13 | 15.2 | 246 | 211 | 498 | 48.6 | 52.1 | 306 | 58.3 | Conventional alloy |

TABLE 3

| No. | Thermal expansion coefficient (RT-750° C.) (×10$^{-6}$/° C.) | Hardness (Hv) | High temperature tensile properties (750° C.) 0.2% yield strength (MPa) | Tensile strength (MPa) | Elongation (%) | Reduction of area (%) | 750° C. creep rupture properties (200 MPa) Time to rupture (h) | Reduction of area (%) | Remarks |
|---|---|---|---|---|---|---|---|---|---|
| 2 | 14.8 | 303 | 629 | 793 | 44. 6 | 42.2 | 2937 | 43.5 | After aging treatment |

It can be understood from Table 2 that any one of Invention superalloy Nos. 1 to 9 has a low thermal expansion coefficient. Also, the invention superalloys exhibit excellent high temperature tensile strength at 750° C. as compared with that of the conventional alloy No. 13, and has ductility at a good level. The time to creep rupture of the invention superalloys is longer than those of Comparative alloy No. 12 and Conventional alloy No. 13, so that the invention superalloys have satisfactory creep rupture strength.

The maximum Vickers hardness (Hv) of the invention superalloys is 208 Hv thereby making it possible to restrain occurrence of cracks when welding.

The creep rupture ductility of the invention superalloys is larger than that of Comparative alloy No. 11. Therefore, it is appreciated that the invention superalloys have satisfactory creep rupture strength and creep rupture ductility as compared with the comparative and conventional alloys.

Further, reviewing Tables 2 and 3, it is appreciated that although Invention alloy No. 2 has slightly lower tensile strength at 750° C. in an alloy structural state as subjected to the solution heat treatment than that of another alloy structural state after aging treatment, it has substantially identical thermal expansion coefficient, creep rupture strength and ductility between both types of the heat treated states. Therefore, it will be appreciated that when the invention superalloy as subjected to the solution treatment is used for boilers in which properties of thermal expansion coefficient, creep rupture strength and ductility are regarded as important, it exhibits satisfactory properties substantially identical to those of the superalloy as subjected to aging treatment and excellent as compared with those of the conventional alloy.

Example 2

With regard to Invention alloy No. 2, a tubular specimen was prepared, which has an outer diameter of 30 mm and a wall thickness of 8 mm. It was subjected to a solution treatment at a heating temperature of 1,066° C. for 4 hours followed by air-cooling, and to a butt welding test thereby obtaining a boiler component. A heat affected zone of the boiler component after welding had a Vickers hardness of 239 Hv.

The welding was carried out by an automatic TIG welding method with utilization of a commercially available welding wire made of a high strength Ni-base alloy. Table 4 shows a chemical composition of the welding wire. Table 5 shows actual welding conditions. No post-welding heat treatment was conducted.

TABLE 4

(mass %)

| C | Cr | Co | Mo | Ti | Al | Balance |
|---|---|---|---|---|---|---|
| 0.07 | 20.3 | 20.0 | 5.9 | 2.2 | 0.5 | Ni and unavoidable impurities |

TABLE 5

| | |
|---|---|
| Shield gas | Argon |
| Welding current (peak/base) | 160/55 to 195/90 A |
| Welding speed | 53 to 94 mm/min. |
| Welding wire feed speed | 400 to 740 mm/min. |

After welding, a weld joint was subjected to a side bending test, in which a bend radius was two times of a wall thickness, and a bending angle was 180 degrees, in accordance with JIS-Z3122. In the bending test, no crack was found, so that a test result was acceptable.

According to an observation of a microstructure at a cross-section of a weld joint, no small defects and cracks were observed, so that the welding was successful. With regard to a base material (i.e. a matrix) of the welding specimen except for a weld portion and a heat affected zone, while an observation of a microstructure was made with utilization of an electron microscope in order to confirm an existence of precipitates of the γ' phase having a size of not less than 20 nm, no coarse precipitates of the γ' phase having a size of not less than 20 nm could be observed.

Next, a tensile test piece and a creep rupture test piece were sampled from the welding specimen so as to crosscut a weld joint portion in order to conduct a tensile test and a creep rupture test. The tests were conducted at a test temperature of 750° C., which temperature was selected on the assumption that the test material is used for a superheater of a boiler operated at a main steam temperature level of 700° C.

Table 6 shows a tensile test result. The weld joint test piece fractured at a weld metal portion. Although tensile strength of the test piece was slightly lower than the base material strength shown in Table 2, it is practically acceptable. Since there were no welding cracks in the interface between the weld metal portion and the base material, and in a heat affected portion, it was confirmed that there is no problem in weldability.

TABLE 6

| Test temperature | Section | Tensile strength | Remarks |
|---|---|---|---|
| 750° C. | Weld joint | 594 MPa | Fracture position is a center of weld metal |
| | Base material | 653 MPa | No. 2 alloy in Table 1 |

Table 7 shows a creep rupture test result.

Weld joint test pieces were fractured in a weld metal portion (in the case of a test temperature of 750° C. and a stress of 200 MPa) like as the case of the tensile test, and in the base material (in the case of a test temperature of 750° C. and a stress of 100 MPa). The time to rupture of the test pieces was slightly shorter than that of the base material as subjected to the solution treatment. However, in light of creep properties, it can be considered that the weld portion has substantially the same strength to that of the base material. Since some test pieces fractured in the base material, it is appreciated that the weld portion was not deteriorated in mechanical properties and sound welding was possible. Further, since there were no welding cracks in the interface between the weld metal portion and the base material, and in a heat affected portion, it was confirmed that the test pieces had no problem also in light of creep rupture strength.

TABLE 7

| Test temperature, stress | Section | Time to rupture | Remarks |
|---|---|---|---|
| 750° C., 200 MPa | Weld joint | 2079 h | Rupture position is a center of weld metal |
| | Base material | 2843 h | No. 2 alloy in Table 1 |
| 750° C., 140 MPa | Weld joint | 9733 h | Rupture position is in base material |
| | Base material | 10021 h | No. 2 alloy in Table 1 |
| 800° C., 100 MPa | Weld joint | 2603 h | Rupture position is in base material |
| | Base material | 2714 h | No. 2 alloy in Table 1 |

In this Example, welding tests were conducted with utilization of the commercially available welding material made of the Ni-base alloy, thereby proving that a sound weld joint can be produced in light of tensile strength, creep rupture strength and a welding position as well as a metallurgical view point. Although in the tensile test and the creep rupture test of the weld joints, some test pieces fractured at the weld metal portion, the test pieces including one in which joint strength is slightly lower than that of the base material, this is derived from a strength of the welding material itself. Thus, it is apparent that a strength of the weld joint can be improved with utilization of a welding material having a much higher strength.

INDUSTRIAL APPLICABILITY

The invention superalloy is excellent in the points of a low thermal expansion coefficient at a temperature of not lower than 700° C., high temperature tensile properties at a temperature of not lower than 700° C., high temperature creep rupture properties at a temperature of not lower than 700° C., and weldability. Thus, the superalloy is applicable to ultra supercritical pressure steam boilers for which it is indispensably subjected to welding, and must have high thermal fatigue strength and satisfactory creep rupture properties at a temperature of not lower than 700° C.

The invention claimed is:

1. A boiler component made of a low-thermal-expansion Ni-base superalloy, the superalloy consisting essentially of, by mass, not more than 0.2% C, not more than 0.5% Si, not more than 0.5% Mn, 10 to 24% Cr, at least one of Mo and W in an amount in terms of an equation of "Mo+0.5W"=5 to 17%, 0.5 to 2.0% Al, 1.0 to 3.0% Ti, not more than 10% Fe, and at least one of B and Zr in amounts of from exclusive zero to 0.02% B and from exclusive zero to 0.2% Zr, and the balance of Ni and unavoidable impurities, wherein no precipitates of a γ' phase having a size of not less than 20 nm exist in an alloy matrix of the Ni-base superalloy other than a weld portion and a heat affected zone by welding, and wherein the superalloy other than the weld portion and the heat affected zone by welding has a Vickers hardness of not more than 240.

2. The boiler component according to claim 1, wherein the superalloy consists essentially of, by mass, 0.005 to 0.15% C, 15 to 24% Cr, 1.2 to 2.5% Ti, not more than 5% Fe, at least one of B and Zr in amounts of 0.002 to 0.02% B and 0.01 to 0.2% Zr, and the balance of 48 to 78% Ni and unavoidable impurities.

3. The boiler component according to claim 1, wherein the superalloy consists essentially of, by mass, 0.5 to 1.7% Al, 1.2 to 1.8% Ti, not more than 2% Fe, and 50 to 70% Ni.

4. The boiler component according to claim 1, wherein a value defined by an equation of Al/(Al+0.56Ti) is 0.45 to 0.70.

5. A method of producing a boiler component made of the Ni-base superalloy as defined in claim 1, comprising the steps of:

melting the Ni-base superalloy;

casting the molten Ni-base superalloy to obtain an ingot;

subjecting the ingot to plastic working of at least one of hot working and cold working; and subjecting the worked product to solution heat treatment at a temperature of 980 to 1100° C., wherein an obtained final product as not aged has a Vickers hardness of not more than 240.

* * * * *